US007658041B2

(12) United States Patent
Andrä et al.

(10) Patent No.: US 7,658,041 B2
(45) Date of Patent: Feb. 9, 2010

(54) ANCHORING FOR STRIP-SHAPED TRACTION ELEMENTS ON SUPPORTING STRUCTURES

(75) Inventors: Hans-Peter Andrä, Stuttgart (DE); Markus Maier, Plieningen (DE); Roger Beyerlein, Berlin (DE)

(73) Assignee: Leonhardt, Andrä und Partner Beratende Ingenieure VBI GmbH, Stuttgart (DE)

( * ) Notice: Subject to any disclaimer, the term of this patent is extended or adjusted under 35 U.S.C. 154(b) by 425 days.

(21) Appl. No.: 10/554,196

(22) PCT Filed: Sep. 2, 2004

(86) PCT No.: PCT/EP2004/009766

§ 371 (c)(1),
(2), (4) Date: Oct. 24, 2005

(87) PCT Pub. No.: WO2005/026471

PCT Pub. Date: Mar. 24, 2005

(65) Prior Publication Data

US 2006/0272246 A1 Dec. 7, 2006

(30) Foreign Application Priority Data

Sep. 9, 2003 (DE) ..... 103 41 376

(51) Int. Cl.
*E04G 23/02* (2006.01)

(52) U.S. Cl. ..... 52/223.14; 52/223.6; 52/223.13; 52/745.21

(58) Field of Classification Search ..... 52/223.6, 52/223.13, 223.14, 745.21; 403/344, 312, 403/310

See application file for complete search history.

(56) References Cited

U.S. PATENT DOCUMENTS 5,289,626 A * 3/1994 Mochida et al. ..... 29/452
6,385,940 B1 * 5/2002 Maier et al. ..... 52/730.2
6,571,518 B1 * 6/2003 Barley ..... 52/223.13
6,584,738 B1 * 7/2003 Andra et al. ..... 52/223.14

FOREIGN PATENT DOCUMENTS

| | | |
|---|---|---|
| EP | 1033455 | 6/2000 |
| EP | 1331327 | 7/2003 |
| JP | 1006823 | 3/1998 |

* cited by examiner

*Primary Examiner*—Robert J Canfield
*Assistant Examiner*—James J Buckle, Jr.
(74) *Attorney, Agent, or Firm*—WRB-IP LLP

(57) ABSTRACT

The clamping element is supported in a positive fit on the base plate in the direction of traction of the traction element in the anchoring for pre-stressed strip-shaped traction elements on supporting structures. The traction element is received between a base plate which is fixed to the supporting structure and a clamping plate which can be clamped against the base plate and is fixed by adhesion and clamping. The clamping plate can include, on each side of the traction element, a retaining cam plate which projects in a downward manner and which engages in a retaining recess of the base plate, or can include a retaining projection which supports a stop which is connected to the base plate. The stops on the upper side of the base plate are welded push blocks which are arranged on both sides and/or in the region of the front side of the clamping plate. The clamping plate can be secured in the position thereof such that it supports the base plate in a positive fit by a positioning device which is mounted in a detachable manner in the direction of traction of the traction element. The positioning device is a threaded rod operating between the clamping element and a bridge connected to the base plate.

18 Claims, 4 Drawing Sheets

ANCHORING FOR STRIP-SHAPED TRACTION ELEMENTS ON SUPPORTING STRUCTURES

The invention relates to an anchoring for strip-shaped traction elements on supporting structures that are under tension, especially concrete supporting structures, in which the traction element is received between a base plate that is attached to the supporting structure and a clamping plate that can be clamped against the base plate, and fixed by means of adhesion and clamping.

The application of pre-stressed, strip-shaped traction elements to the surface of the supporting structure after the fact to increase (enhance) the supporting capacity, or to restore the original supporting capacity (restoration) of supporting structures made of steel-reinforced concrete, pre-stressed concrete, or steel, for example, is known. Plastic strips after the manner of lamellae, for example, with embedded carbon fibers, are used as traction elements. For anchoring, base plates made of steel, for example, are pinned into recesses of the surface of the concrete and/or attached by adhesion.

In order to apply the requisite pre-stress to the strip-shaped traction member prior to its permanent anchoring, the traction element is anchored at one end (the fixed side) between a base plate, which is connected to the supporting structure, and a clamping plate by means of adhesion and clamping, such that, if necessary, a temporary clamping can be undertaken initially, by means of a clamping bridge, for example, before the final anchoring occurs by means of adhesion and clamping. At the other end of the traction element (the tension side), the traction element is clamped in a temporary traction anchor, which is repositioned by means of a traction device opposite the base plate, which is applied there to the supporting structure, as a result of which the traction element is placed under tension (DE 198 49 605 A1). Then the tension element is fixed by means of adhesion and clamping between the base plate and a clamping plate on the tension side as well, before the temporary tension anchor is removed.

The tension is introduced to the base plate and thus, into the traction element, via adhesion on the underside of the traction element. The clamping plate, which is adhered to the top of the traction element, essentially serves to assure the introduction of the force from the traction element into the base plate by the application of a sufficiently high clamping force. The transferable tension is thus essentially limited by the greatest possible shearing stress in the adhesive layer between the traction element and the base plate.

Therefore, it is the task of the invention to embody an anchoring of the type mentioned at the outset in such a manner that a marked elevation of the tension to be applied is rendered possible.

This task is resolved according to the invention by virtue of the fact that the clamping plate is supported, so as to have positive fit, against the base plate in the traction element's direction of traction. Thus, in addition to the adhesive connection on the underside of the traction element, the adhesive connection on the top can also be used to its full extent to anchor the traction element. In contrast to the known connection, which transfers force exclusively between the base plate and the traction element, with the solution according to the invention, a two-shear connection is achieved, because both the adhesive surface between the traction element and the base plate as well as the adhesive surface between the traction element and the clamping plate are utilized to transfer the force. If the shear stresses imposed remain unchanged in both adhesive surfaces, the transferable traction is thus increased.

If the transferred traction were retained, the stress of shear in the adhesive surfaces would be reduced compared to the simple connection.

In an extension of the inventive thought, provision is made so that the positive fitting support of the clamping plate on the base plate is accomplished to good advantage by virtue of the fact that the clamping plate, on either side of the traction element, exhibits, in each case, a downwardly protruding securing tappet, which engages a securing recess of the base plate in each case. In the process, the additional space required is very slight.

According to another preferred embodiment of the invention, provision is made so that the clamping plate exhibits a securing protrusion on either side, which is supported in each case against a stop that is connected with the base plate. In its stead, the clamping plate can also be supported against two stops that are connected with the base plate with the front surface that is on the traction side. In the process, the surfaces that come to engage each other are readily accessible, and therefore they can be worked on with the requisite precision, without great expense.

BRIEF DESCRIPTION OF THE DRAWINGS

In what follows, the invention is illustrated in greater detail by virtue of embodiments that are depicted in the drawing.

In a top view.

DETAILED DESCRIPTION

A band-shaped traction element 1, for example, a carbon fiber-reinforced plastic lamella, is intended to be attached to the surface of a supporting structure 2, a concrete supporting structure, for example. The traction element 1 must be pre-stressed prior to fixation on supporting structure 2.

Figure 1:
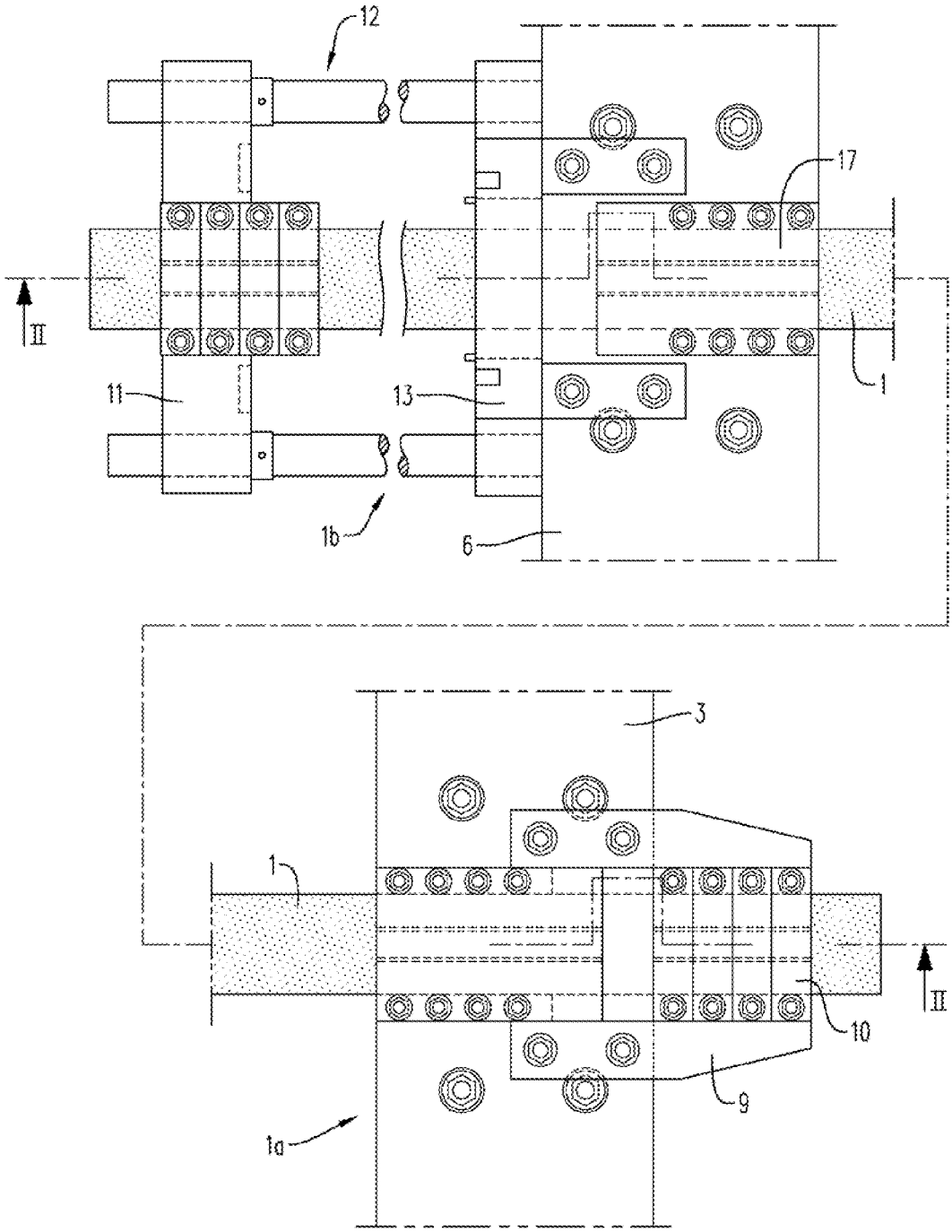
FIG. 1 shows the anchoring of a traction element on a supporting structure in the form of a strip, such that both ends of the traction element are depicted.
Figure 2:
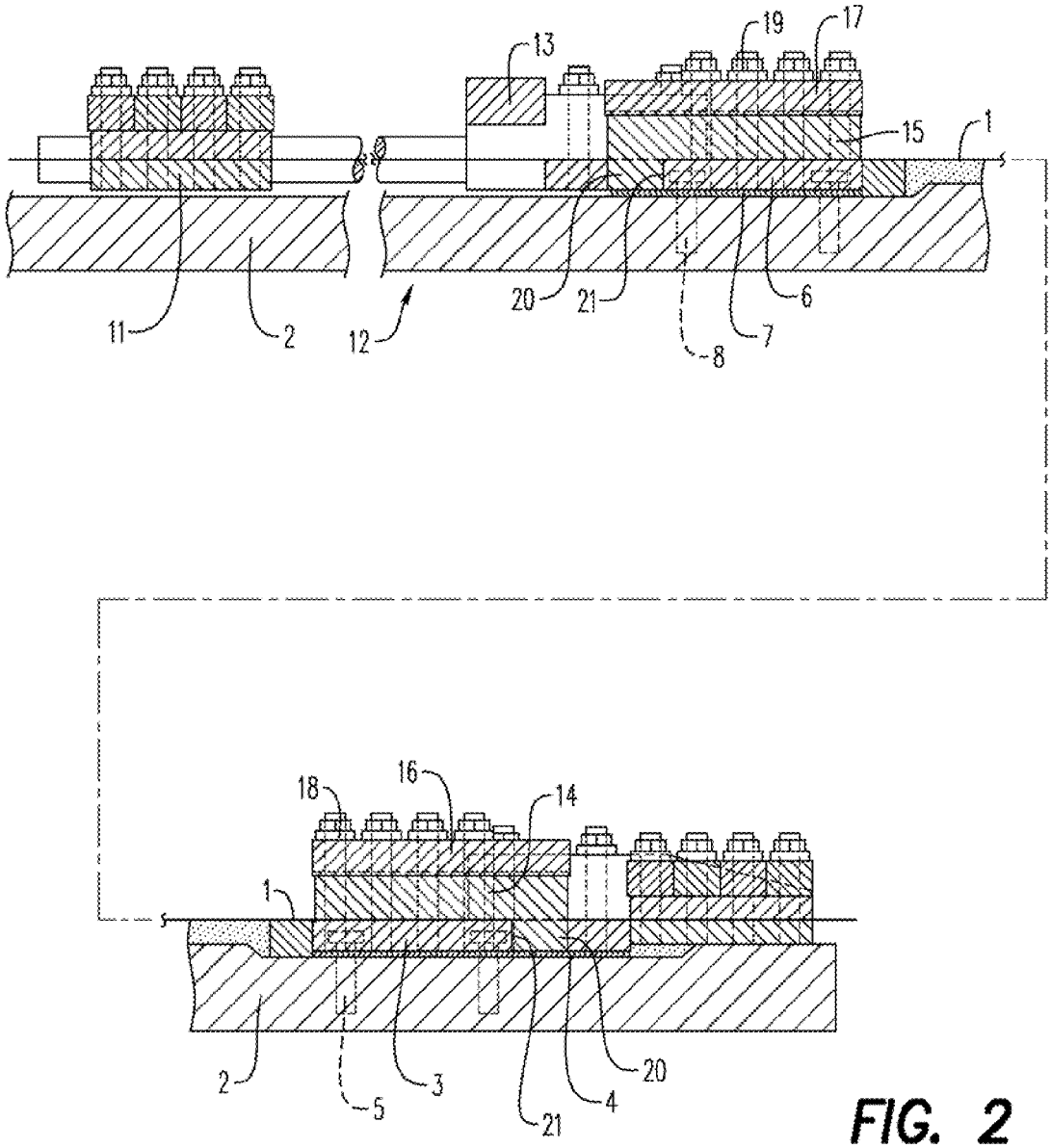
FIG. 2 shows a section along line II-II in FIG. 1.

As depicted in FIGS. 1 and 2, the traction element 1 is anchored to a base plate 3 at one of its ends 1*a* (the fixed side), which is fixed by way of an adhesive layer 4 and pins 5 to the supporting structure 2. In the same manner, the other end 1*b* of traction element 1, in its completed state, is anchored on the tension side to a base plate 6, which is anchored to supporting structure 2 by means of an adhesive layer 7 and pins 8.

In order to apply the pre-stress to the traction element 1, on the fixed side, a clamping bridge 9, which is applied to the base plate 3 in such a way that it can be released, engages with a clamping set 10 on the traction element 1. On the tension side, a clamping set 11 engages traction element 1, which constitutes a portion of a tensioning device 12, whose tensioning traverse 13 is applied to the base plate 6 in such a manner that it can be released. As a result of a shift of the clamping set 11 away from the tension traverse 13 by means of a tension drive (not depicted), the traction element 1 is pre-stressed before it is fixed on the surface of the supporting structure 2 and on the base plates 3 and 6 by means of adhesion.

A clamping plate 14 or 15 is found over each base plate 3, 6, respectively. A layer of adhesive is applied, in each case, between the traction element 1 and the base plates 3, 6 and the clamping plates 14, 15.

Both clamping plates 14, 15 are pressed against the traction element 1 and the base plate 3 or 6 by way of a clamping bridge 16 or 17, located at the top, in each case, by means of lateral screws 18 or 19 and the base plate 3 or 6.

Both clamping plates 14, 15 are supported in the traction element's 1 direction of traction in a positive fit on the allocated base plate 3 or 6, in each case. To this end, in the embodiment according to FIGS. 1 and 2, both clamping plates 14, 15 exhibit, in each case, on either side of the traction element 1, a downwardly protruding securing tappet 20, which engages, in each case, a securing recess 21 of the base plate 3 or 6, respectively, and is supported, in the direction of traction, against the lateral wall of recess 21.

The tension that can be diverted from traction element 1 into supporting structure 2 is thus transferred by the adhesive layer's stresses of shear, in each case, directly into the base plates 3 and 6, on the one hand and, on the other hand, to the base plates 3 and 6 by way of the clamping plates 14 and 15 and their securing tappets 20. In this manner, in each case, a two-shear connection of the ends 1*a* and 1*b* of the traction element 1 with the supporting structure 2 is achieved.

Figure 3:
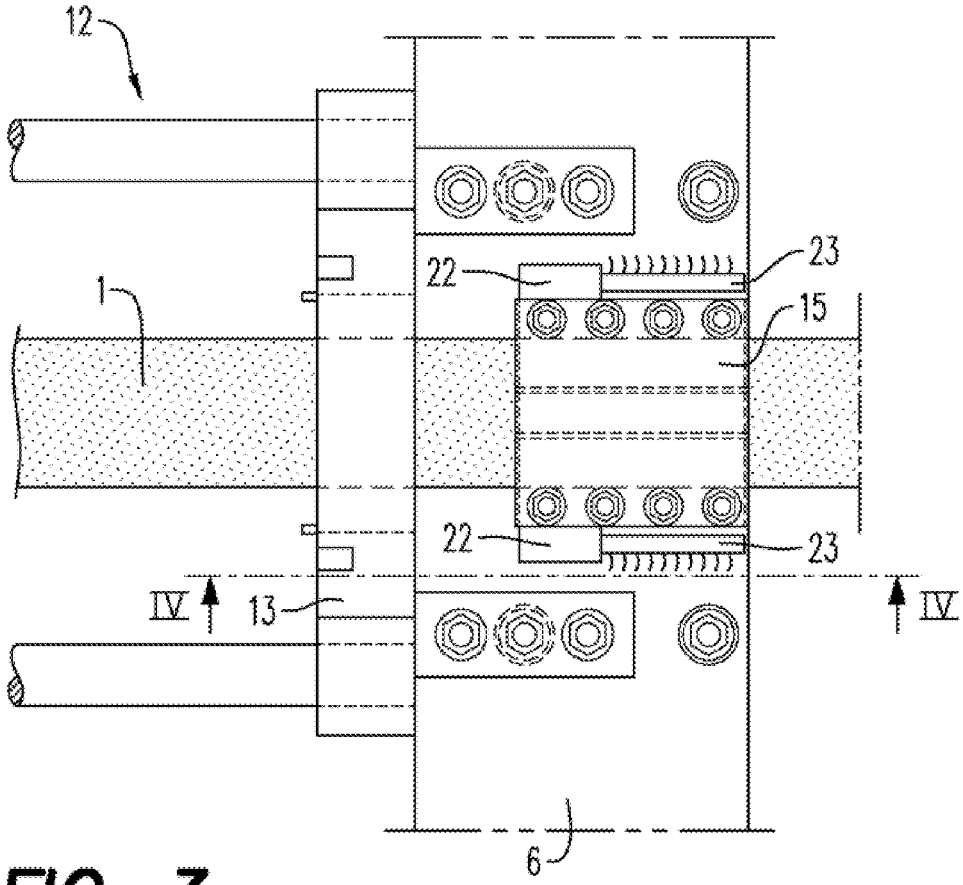
FIG. 3 shows, in a representation that corresponds to FIG. 1, a modified embodiment of the anchoring, depicted on the tension side of the strip-shaped traction element.
Figure 4:
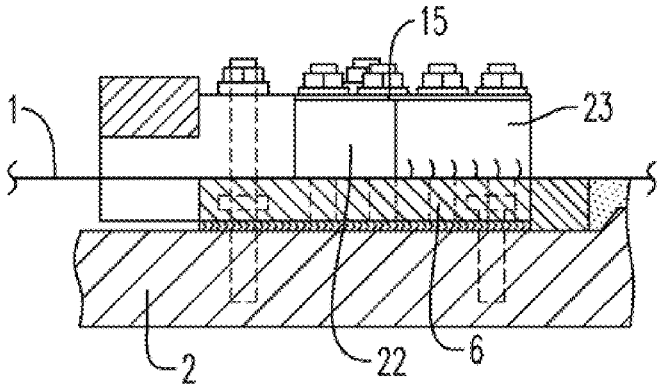
FIG. 4 shows a section along line IV-IV in FIG. 3, FIG. 5, in a representation corresponding to FIG. 3, shows another modified embodiment of the anchoring.
Figure 5:
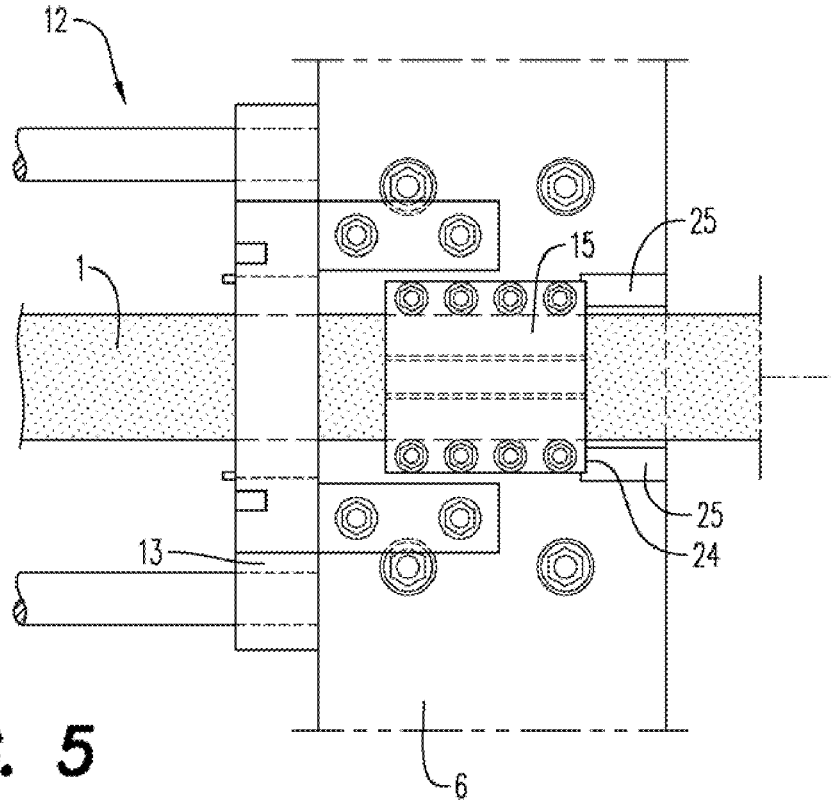

In the embodiment depicted in FIGS. 3 and 4 (of which only the side under tension is shown), clamping plate 15 exhibits, on both sides, a securing projection 22, which is supported, in each case, against a stop 23 that is connected with the base plate 6. In the case of the embodiment depicted, the stops 23 on the top of the base plate 6 on either side of the clamping plate 15 are welded-on push blocks. An embodiment, by way of comparison, which was a variation of the latter, is depicted in FIG. 5. In this instance, clamping plate 15, with its front surface 24 facing the direction of traction, is supported against two stops 25, which are welded onto the top of the base plate 6 and are connected with the base plate 6.

Figure 6:
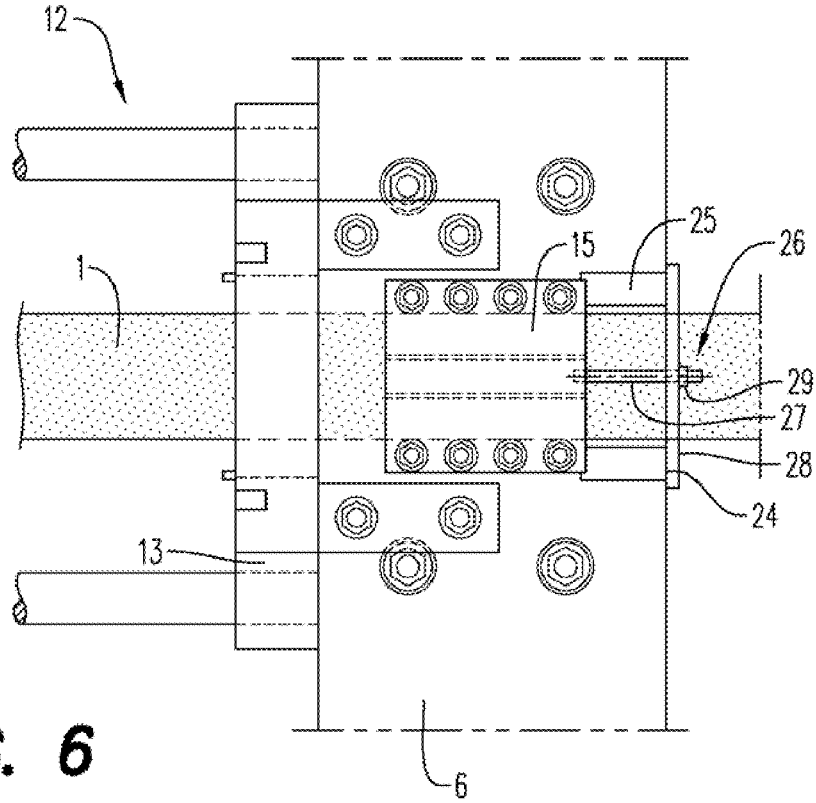
FIG. 6 shows the anchoring according to FIG. 5 with an additional positioning device for the clamping plate.

Taking the embodiment according to FIG. 5 as a point of departure, FIG. 6 shows that clamping plate 15 may be fixed in its position, lying against the base plate 6 in a positive fit, by means of a positioning device 26, which acts in the traction element's 1 direction of traction. What is achieved by these means is that clamping plate 15, even at the beginning of the transfer of the tension force, is found lying against the stops 25 in a positive fit. The adhesive connections of traction element 1 with base plate 6 and clamping plate 15 therefore participate in the transfer of force to equal degrees.

In the case of the embodiment depicted in FIG. 6, positioning device 26 exhibits a threaded rod 27, which works between the clamping plate 15 and a bridge 28, which is connected with the base plate 6. The bridge 28 is, for example, a simple flat piece of iron with a borehole, through which threaded rod 27, which is screwed into a threaded borehole on the end on the front of clamping plate 15 extends, and which, outside of bridge 28, bears a nut 29. The bridge 28 lies adjacent to the back of the stops 25. By tightening the nut 29, the clamping plate 15 is made to lie adjacent to the stops 25. The positioning device 26 can be removed.

In lieu of that, the positioning device can also exhibit at least one wedge (not depicted), which works between the base plate 6 and the clamping plate 15. It is also possible to use a removable threaded collet, or the like, as a positioning device.

The invention claimed is:

1. An anchoring for a strip-shaped traction element on a supporting structure that is under tension, comprising a base plate attached to the supporting structure and a clamping plate clamped against the base plate and fixed by adhesion and clamping, wherein the clamping plate is supported on the base plate in a positive fit in a direction of tension in the traction element, wherein the clamping plate comprises a substantially integral downwardly protruding securing tappet which engages a securing surface of the base plate.

2. An anchoring according to claim 1, wherein the clamping plate, on either side of the traction element, comprises, in each case, a downwardly protruding securing tappet which engages, in each case, a securing surface of the base plate.

3. An anchoring for a strip-shaped traction element on a supporting structure that is under tension, comprising a base plate attached to the supporting structure and a clamping plate clamped against the base plate and fixed by adhesion and clamping, wherein the clamping plate is supported on the base plate in a positive fit in a direction of tension in the traction element, wherein the clamping plate exhibits, on either side, in each case, a securing protrusion which is supported, in each case, against a substantially integral, upwardly extending stop that is connected with the base plate.

4. An anchoring for a strip-shaped traction element on a supporting structure that is under tension, comprising a base plate attached to the supporting structure and a clamping plate clamped against the base plate and fixed by adhesion and clamping, wherein the clamping plate is supported on the base plate in a positive fit in a direction of tension in the traction element, wherein the clamping plate, with its front surface facing in the direction of tension in the traction element, is supported against two substantially integral, upwardly extending stops that are connected with the base plate.

5. An anchoring according to claim 4, wherein the stops on the base plate are welded-on push blocks.

6. An anchoring according to claim 1, wherein the clamping plate is fixed in position by a positioning device which engages the clamping plate in the direction of tension in the traction element in positive fitting support against the base plate.

7. An anchoring according to claim 6, wherein the positioning device is adapted to be removed from the anchoring.

8. An anchoring according to claim 6, wherein the positioning device comprises a threaded rod disposed between the clamping plate and a bridge that is connected with the base plate.

9. An anchoring according to claim 6, wherein the positioning device comprises a removable threaded collet.

10. An anchoring according to claim 3, wherein the stops on the base plate are welded-on push blocks.

11. An anchoring according to claim 2, wherein the clamping plate is fixed in position by a positioning device which engages the clamping plate in the direction of tension in the traction element in positive fitting support against the base plate.

12. An anchoring according to claim 3, wherein the clamping plate is fixed in position by a positioning device which engages the clamping plate in the direction of tension in the traction element in positive fitting support against the base plate.

13. An anchoring according to claim 4, wherein the clamping plate is fixed in position by a positioning device which engages the clamping plate in the direction of tension in the traction element in positive fitting support against the base plate.

14. An anchoring according to claim 5, wherein the clamping plate is fixed in position by a positioning device which engages the clamping plate in the direction of tension in the traction element in positive fitting support against the base plate.

15. An anchoring according to claim 10, wherein the clamping plate is fixed in position by a positioning device which engages the clamping plate in the direction of tension in the traction element in positive fitting support against the base plate.

16. An anchoring according to claim 8, wherein the threaded rod extends in the direction of tension in the traction element.

17. An anchoring according to claim 1, wherein the traction element is fixed between the base plate and the clamping plate by adhesive on sides of the traction element facing the base plate and the clamping plate and by clamping.

18. An anchoring according to claim 1, wherein tension in the traction element is transferred substantially equally from the traction element to the base plate and the clamping plate.

* * * * *